US005921867A

United States Patent [19]

Mayeux

[11] Patent Number: 5,921,867

[45] Date of Patent: Jul. 13, 1999

[54] SELF-PROPELLED MERRY-GO-ROUND

[76] Inventor: Timothy J. Mayeux, 9586 Highway 165 S., Woodworth, La. 71485

[21] Appl. No.: 09/070,563

[22] Filed: Apr. 30, 1998

[51] Int. Cl.[6] ..... A63G 1/14

[52] U.S. Cl. ..... 472/19; 472/14

[58] Field of Search ..... 472/4, 5, 14, 19, 472/21

[56] References Cited

U.S. PATENT DOCUMENTS

| | | | |
|---|---|---|---|
| D. 99,613 | 5/1936 | Sweet | D21/249 |
| D. 287,262 | 12/1986 | McNutt et al. | D21/249 |
| 2,699,335 | 1/1955 | Krueger, Jr. | 472/19 |
| 2,739,811 | 3/1956 | Persons | 472/19 |
| 2,835,491 | 5/1958 | Meyers | 472/5 |
| 3,199,868 | 8/1965 | Motyka | 472/19 |
| 3,758,108 | 9/1973 | Tada | 472/5 |
| 3,968,961 | 7/1976 | Mancusi, Jr. | 472/29 |
| 3,985,352 | 10/1976 | Nitzsche | 472/19 |
| 4,286,781 | 9/1981 | Ahrens | 472/14 |
| 4,982,949 | 1/1991 | Ulferts | 472/14 |

*Primary Examiner*—Kien T. Nguyen

[57] ABSTRACT

A self propelled merry-go-around is provided including a base having a plurality of linear feet and a vertical stanchion fixedly coupled to the feet and extending upwardly therefrom. A pivoting assembly includes at least one arm rotatably coupled to a top end of the vertical stanchion. The arm has an outboard end with a seat and at least one post having a bar coupled to both a top end and a bottom end thereof in perpendicular relationship with the post. A central extent of the post is pivotally coupled to at least one end of the second arm just inward of the corresponding seat. A drive assembly is provided including a drive member with an inverted L-shaped configuration fixedly coupled to a top of the vertical stanchion. At least one interconnect rod has a first end pivotally coupled to the post of the arm of the pivoting assembly and a second end pivotally coupled to an outboard end of the drive member for effecting the rotation of the pivoting assembly.

1 Claim, 3 Drawing Sheets

SELF-PROPELLED MERRY-GO-ROUND

BACKGROUND OF THE INVENTION

1. Field of the Invention

The present invention relates to merry-go-rounds and more particularly pertains to a new self-propelled merry-go-round for providing a superior means of propelling a merry-go-round manually.

2. Description of the Prior Art

The use of merry-go-rounds is known in the prior art. More specifically, merry-go-rounds heretofore devised and utilized are known to consist basically of familiar, expected and obvious structural configurations, notwithstanding the myriad of designs encompassed by the crowded prior art which have been developed for the fulfillment of countless objectives and requirements.

Known prior art merry-go-rounds include U.S. Pat. No. 3,985,352; U.S. Pat. No. 4,982,949; U.S. Pat. No. 3,758,108; U.S. Pat. No. 4,286,781; U.S. Pat. No. 3,968,961; and U.S. Des. Pat. No. 287,262.

In these respects, the self-propelled merry-go-round according to the present invention substantially departs from the conventional concepts and designs of the prior art, and in so doing provides an apparatus primarily developed for the purpose of providing a superior means of propelling a merry-go-round manually.

SUMMARY OF THE INVENTION

In view of the foregoing disadvantages inherent in the known types of merry-go-rounds now present in the prior art, the present invention provides a new self-propelled merry-go-round construction wherein the same can be utilized for providing a superior means of propelling a merry-go-round manually.

The general purpose of the present invention, which will be described subsequently in greater detail, is to provide a new self-propelled merry-go-round apparatus and method which has many of the advantages of the merry-go-rounds mentioned heretofore and many novel features that result in a new self-propelled merry-go-round which is not anticipated, rendered obvious, suggested, or even implied by any of the prior art merry-go-rounds, either alone or in any combination thereof.

To attain this, the present invention generally comprises a base having a pair of elongated linear feet coupled at central extents thereof in perpendicular relationship. During use, the feet rest flat on a recipient surface, as shown in FIG. 1. A vertical stanchion is fixedly coupled to the central extents of the feet and extended upwardly therefrom. A plurality of supports are provided for securing the vertical stanchion in relation to the feet. Next provided is a pivoting assembly including a pair of elongated linear arms. The arms are coupled at central extents thereof in perpendicular relationship. Further, the arms are rotatably coupled to a top end of the vertical stanchion of the base such that the arms rotate while remaining entirely within a horizontally oriented plane. Each arm has an outboard end with a plate mounted to a top face thereof. As shown in FIG. 4, such plate is adapted for the coupling of a seat with a planar rectangular configuration thereto. A first one of the arms includes a linear post fixedly and perpendicularly coupled at a central extent thereof to each end just inward of the corresponding seat. Each linear post has a short linear bar coupled to both a top end and a bottom end thereof in perpendicular relationship with the post. See FIG. 1. Associated therewith is a second one of the arms including two pairs of parallel posts. Each pair of parallel posts has a short linear bar coupled to both a top end and a bottom end thereof in perpendicular relationship with the parallel posts. A central extent of each pair of parallel posts is pivotally coupled to each end of the second arm just inward of the corresponding seat. A drive member is included with an inverted L-shaped configuration fixedly coupled to a top of the vertical stanchion and extending through a bore formed in the sleeve. A pair of linear interconnect rods each have a first end pivotally coupled about a horizontal axis between one of the pairs of parallel posts of the second arm of the pivoting assembly. A second end of each interconnect rod is pivotally coupled to an outboard end of the drive member about a vertical axis. By this structure, a pair of users may effect the rotation of the pivoting assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self-propelled merry-go-round apparatus and method which has many of the advantages of the merry-go-rounds mentioned heretofore and many novel features that result in a new self-propelled merry-go-round which is not anticipated, rendered obvious, suggested, or even implied by any of the prior art merry-go-rounds, either alone or in any combination thereof.

It is another object of the present invention to provide a new self-propelled merry-go-round which may be easily and efficiently manufactured and marketed.

It is a further object of the present invention to provide a new self-propelled merry-go-round which is of a durable and reliable construction.

An even further object of the present invention is to provide a new self-propelled merry-go-round which is susceptible of a low cost of manufacture with regard to both materials and labor, and which accordingly is then susceptible of low prices of sale to the consuming public, thereby making such self-propelled merry-go-round economically available to the buying public.

Still yet another object of the present invention is to provide a new self-propelled merry-go-round which provides in the apparatuses and methods of the prior art some of the advantages thereof, while simultaneously overcoming some of the disadvantages normally associated therewith.

Still another object of the present invention is to provide a new self-propelled merry-go-round for providing a superior means of propelling a merry-go-round manually.

Even still another object of the present invention is to provide a new self-propelled merry-go-round that includes a base having a plurality of linear feet and a vertical stanchion fixedly coupled to the feet and extending upwardly therefrom. A pivoting assembly includes at least one arm rotatably coupled to a top end of the vertical stanchion. The arm has an outboard end with a seat and at least one post having a bar coupled to both a top end and a bottom end thereof in perpendicular relationship with the post. A central extent of the post is pivotally coupled to at least one end of the second arm just inward of the corresponding seat. A drive assembly is provided including a drive member with an inverted L-shaped configuration fixedly coupled to a top of the vertical stanchion. At least one interconnect rod has a first end pivotally coupled to the post of the arm of the pivoting assembly and a second end pivotally coupled to an outboard end of the drive member for effecting the rotation of the pivoting assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
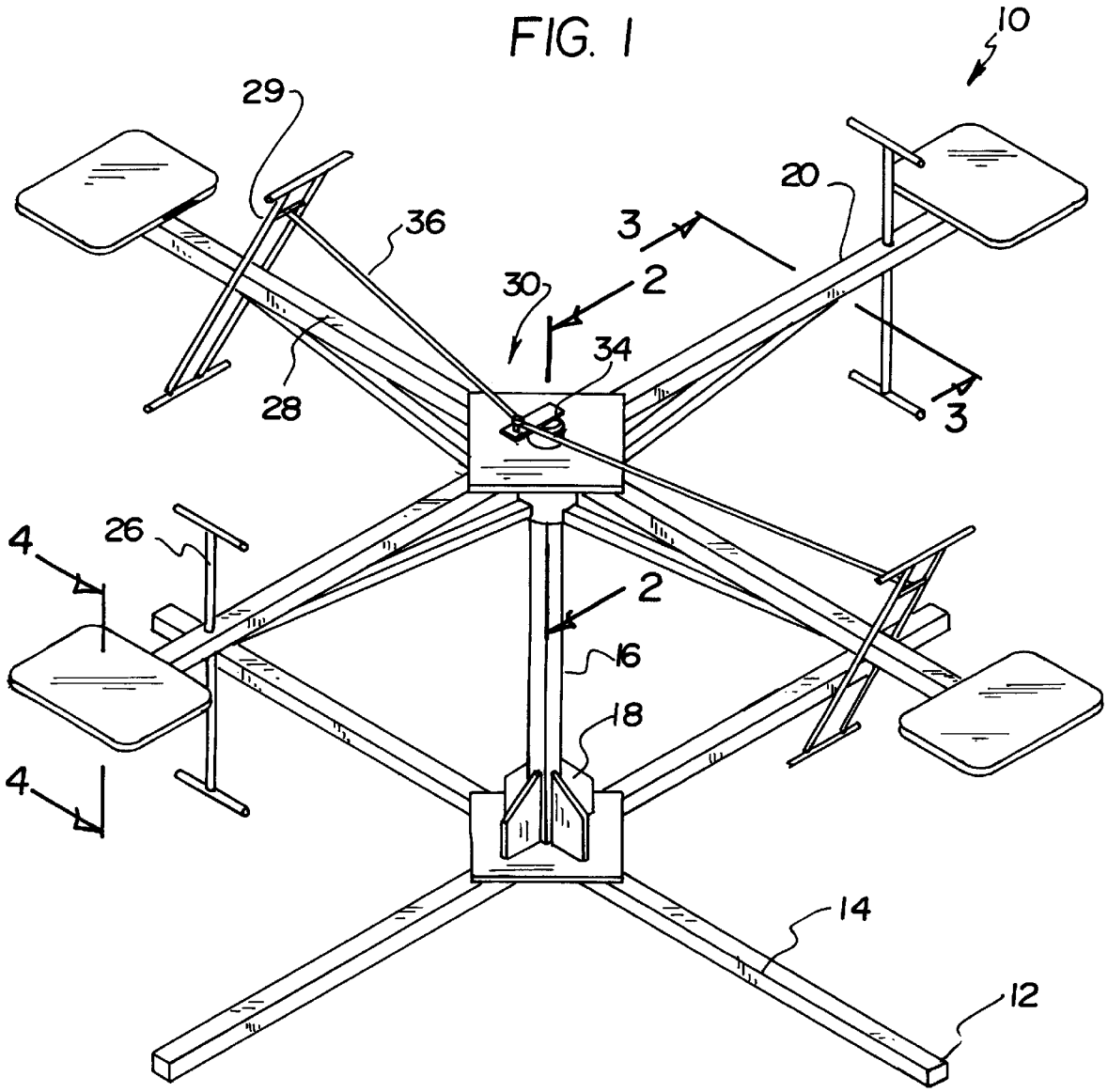
FIG. 1 is a perspective view of a new self-propelled merry-go-round according to the present invention.

With reference now to the drawings, and in particular to FIGS. 1 through 5 thereof, a new self-propelled merry-go-round embodying the principles and concepts of the present invention and generally designated by the reference numeral 10 will be described.

The present invention, designated as numeral 10, includes a base 12 having a pair of elongated linear feet 14 coupled at central extents thereof in perpendicular relationship. During use, the feet rest flat on a recipient surface, as shown in FIG. 1. A vertical stanchion 16 is fixedly coupled to the central extents of the feet and extended upwardly therefrom. A plurality of supports 18 are provided for securing the vertical stanchion in relation to the feet. Such supports preferably including a square plate for coupling each of the feet fixed with respect to each other. In addition, a plurality of generally triangular plates are mounted between the vertical stanchion and the square plate for securing the position of the vertical stanchion.

Figure 2:
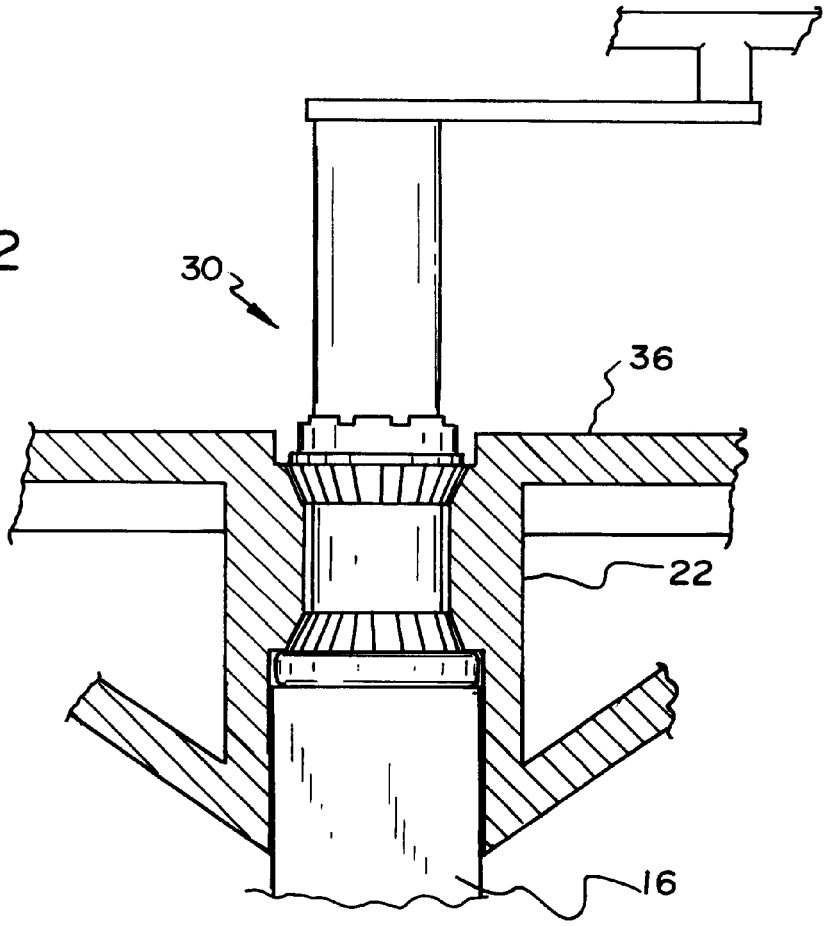
FIG. 2 is a side cross-sectional view of the drive mechanism of the present invention.
Figure 3:
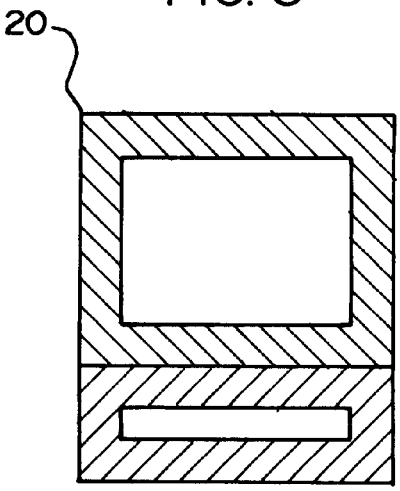
FIG. 3 is a cross-sectional view of the present invention taken along line 3—3 shown in FIG. 1.

Next provided is a pivoting assembly including a pair of elongated linear arms 20. The arms are coupled at central extents thereof in perpendicular relationship. Further, the arms are rotatably coupled to a top end of the vertical stanchion of the base such that the arms rotate while remaining entirely within a horizontally oriented plane. This is preferably accomplished by way of a sleeve 22, as shown in FIG. 2. Such sleeve preferably includes a bottom portion with a bearing aperture for receiving the top end of the vertical stanchion. A horizontally oriented square plate is mounted to a central extent of the sleeve for coupling with the central extents of the arms 20. For additional support, a truss is coupled between a lower surface of the outboard end of each arm and the bottom portion of the sleeve. Further, a bore is formed in a top portion of the sleeve 22 for reasons that will become apparent hereinafter.

Figure 4:
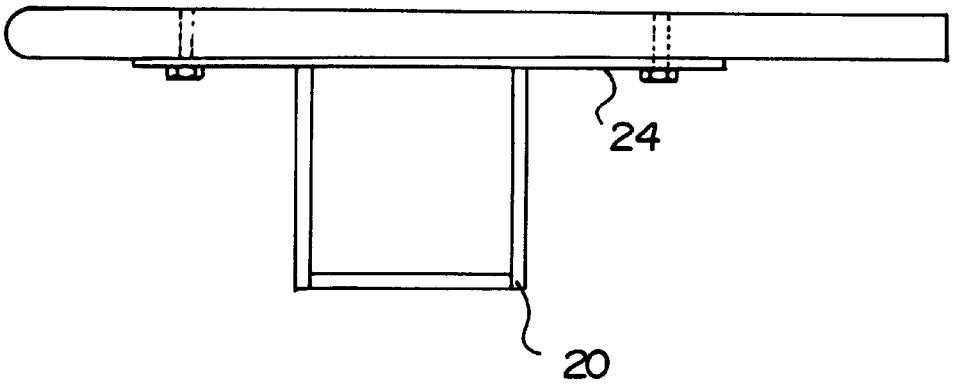
FIG. 4 is a cross-sectional view of the seat of the present invention taken along line 4—4 shown in FIG. 1.
Figure 5:
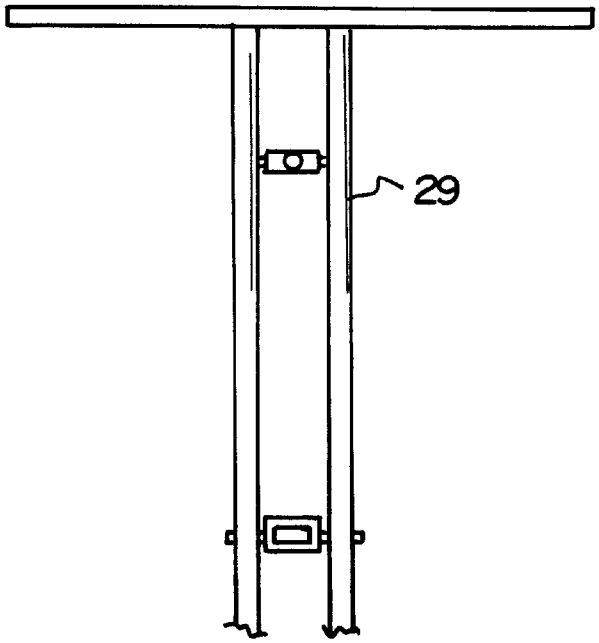
FIG. 5 is a front view of one of the parallel bars of the second arm of the present invention.

Each arm has an outboard end with a plate 24 mounted to a top face thereof. As shown in FIG. 4, such plate is adapted for the bolted coupling of a seat with a planar rectangular configuration thereto. It is preferred that each seat be horizontally oriented.

A first one of the arms includes a linear post 26 fixedly and perpendicularly coupled at a central extent thereof to each end just inward of the corresponding seat. Each linear post has a short linear bar coupled to both a top end and a bottom end thereof in perpendicular relationship with the post. See FIG. 1.

Associated therewith is a second one of the arms 28 including two pairs of parallel posts 29. Each pair of parallel posts has a short linear bar coupled to both a top end and a bottom end thereof in perpendicular relationship therewith. During use, a central extent of each pair of parallel posts is pivotally coupled to the associated end of the second arm just inward of the corresponding seat.

Finally, a drive assembly 30 is provided including a drive member 34 with an inverted L-shaped configuration. The drive member is fixedly coupled to a top of the vertical stanchion and extends through the bore formed in the sleeve 22. Note FIG. 2.

A pair of rigid and linear interconnect rods 36 each have a first end pivotally coupled about a horizontal axis between one of the pairs of parallel posts of the second arm of the pivoting assembly. A second end of each interconnect rod is pivotally coupled to an outboard end of the drive member about a vertical axis. By this structure, a pair of users may effect the rotation of the pivoting assembly while another pair of users ride on the seats of the first arm. At the very minimum, a single user may employ the present invention. Further, in alternate embodiments, only the second arm is included.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A self propelled merry-go-around comprising, in combination:

a base including a pair of elongated linear feet coupled at central extents thereof in perpendicular relationship and resting flat on a recipient surface, a vertical stanchion fixedly coupled to the central extents of the feet and extending upwardly therefrom, and a plurality of supports for securing the vertical stanchion in relation to the feet, wherein the supports include a generally square plate for coupling each of the feet to each other and a plurality of generally triangular plates mounted between the vertical stanchion and the square plate;

a pivoting assembly including a pair of elongated linear arms coupled at central extents thereof in perpendicular relationship and further rotatably coupled to a top end of the vertical stanchion such that the arms rotate while remaining entirely within a horizontally oriented plane, the elongated linear arms being rotatable coupled to the vertical stanchion via a sleeve with a bottom portion including a bearing for receiving the top end of the vertical stanchion and a horizontally oriented square plate mounted to a top of the sleeve for coupling with top surfaces of the central extents of the arms wherein a truss is coupled between a lower surface of the outboard end of each arm and the bottom portion of the sleeve, the outboard end of each arm having a plate mounted to a top face thereof for allowing the coupling of a seat with a planar rectangular configuration thereto, a first one of the arms including a linear post perpendicularly coupled at a central extent thereof to each end of the first arm just inward of the corresponding seat with each linear post having a short linear bar coupled to both a top end and a bottom end thereof in perpendicular relationship with the post, each of the linear posts being fixedly mounted to the first arm to preclude relative movement therebetween upon rotation of the pivoting assembly a second one of the arms including a pair of parallel posts each having a short linear bar coupled to both a top end and a bottom end thereof in perpendicular relationship with the parallel posts and extending therefrom to define free ends wherein a central extent of the parallel posts are pivotally coupled at a central extent thereof to each end of the second arm just inward of the corresponding seat; and a drive assembly including a drive member with an inverted L-shaped configuration fixedly coupled to a top of the vertical stanchion and extending through a bore formed in the sleeve, a pair of linear interconnect rods each having a first end pivotally coupled about a horizontal axis between one of the pairs of parallel posts of the second arm of the pivoting assembly and a second end pivotally coupled to an outboard end of the drive member about a vertical axis for effecting the rotation of the pivoting assembly.

* * * * *